US007886754B2

(12) United States Patent
Hausen

(10) Patent No.: US 7,886,754 B2
(45) Date of Patent: Feb. 15, 2011

(54) ULTRASONIC CLEANING APPARATUS AND HOUSEHOLD APPLIANCE HAVING THE SAME

(75) Inventor: Philipp Hausen, Bonn (DE)

(73) Assignee: Electrolux Home Products Corporation N.V., Zaventem (BE)

( * ) Notice: Subject to any disclaimer, the term of this patent is extended or adjusted under 35 U.S.C. 154(b) by 187 days.

(21) Appl. No.: 11/813,565

(22) PCT Filed: Dec. 23, 2005

(86) PCT No.: PCT/EP2005/014007

§ 371 (c)(1),
(2), (4) Date: Jul. 9, 2007

(87) PCT Pub. No.: WO2006/074803

PCT Pub. Date: Jul. 20, 2006

(65) Prior Publication Data

US 2008/0149150 A1 Jun. 26, 2008

(30) Foreign Application Priority Data

Jan. 14, 2005 (EP) ..... 05000649

(51) Int. Cl.
*B08B 3/12* (2006.01)
*B08B 6/00* (2006.01)

(52) U.S. Cl. ..... 134/184; 68/3 R

(58) Field of Classification Search ..... None
See application file for complete search history.

(56) References Cited

U.S. PATENT DOCUMENTS 3,089,790 A * 5/1963 Balamuth et al. ..... 134/1
6,138,698 A * 10/2000 Tanaka et al. ..... 134/184
2002/0134177 A1 9/2002 Nobusige et al.

FOREIGN PATENT DOCUMENTS

JP 2001310165 4/2002
JP 2003245497 A * 9/2003

OTHER PUBLICATIONS

Kitaori, Noriyuki et al., Jun. 2001, JP 2001-310165 English machine translation.*
Satomura et al., JP 2003-245497, Sep. 2003, English machine translation.*

* cited by examiner

*Primary Examiner*—Michael Barr
*Assistant Examiner*—Jason Y Ko
(74) *Attorney, Agent, or Firm*—Pearne & Gordon LLP

(57) ABSTRACT

The invention relate to an ultrasonic cleaning apparatus (1) for treating textile products comprising a body (2, 3) including an opening (7), wherein at least a portion of the body (2) is formed as a gripping element, an ultrasonic transducer (4) receiving ultrasonic wave signals generated by an ultrasonic signal generator, and an ultrasonic wave emission surface (6) coupled to the ultrasonic transducer. The ultrasonic cleaning apparatus is characterized by a control device (16) adapted to detect the ultrasonic wave emission surface (6) being in contact or in close proximity to an object and to stop the operation of the ultrasonic transducer (4) upon detection of the ultrasonic wave emission surface not being in contact or in close proximity to the object.

8 Claims, 1 Drawing Sheet

ULTRASONIC CLEANING APPARATUS AND HOUSEHOLD APPLIANCE HAVING THE SAME

Figure 1:
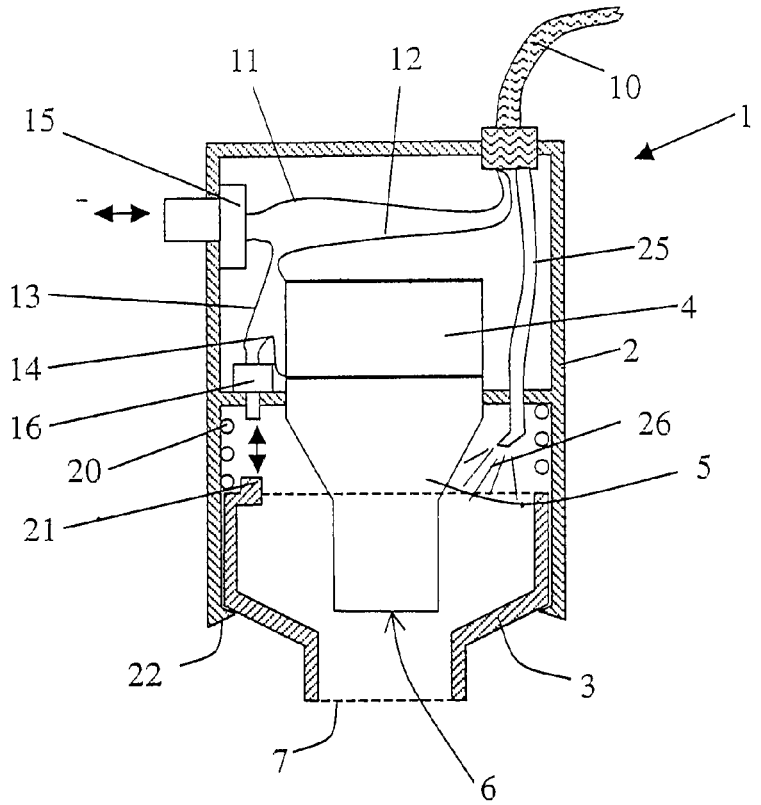

The invention relates to an ultrasonic cleaning apparatus for treating textile products, in particular to an ultrasonic washer, and a household appliance having such an ultrasonic cleaning apparatus.

JP 2003 053084 A and JP 2002 191892 A both disclose an ultrasonic partial washing machine having a body formed as a wand and operated as a handheld device. An opening is formed at a tip section of the body wherein an ultrasonic beam emitting surface of an ultrasonic horn is arranged in the opening. At the opposing side of the ultrasonic emitting surface a transducer is arranged which emits ultrasonic waves to the horn coupled thereto. Within the body are further arranged an ultrasonic wave generator for driving the transducer and an accumulator providing power supply to the ultrasonic generator.

It is an object of the invention to provide an ultrasonic cleaning apparatus and a household appliance having the same, wherein the operating safety of the apparatus is improved.

The ultrasonic cleaning apparatus comprises an ultrasonic transducer and an ultrasonic wave emission surface coupled to the ultrasonic transducer which are both arranged within a body. For example the ultrasonic wave emission surface is a front surface of a horn which itself is coupled to the ultrasonic transducer. The horn amplifies the ultrasonic vibration such that high ultrasonic amplitudes are emitted from the ultrasonic wave emission surface. The ultrasonic wave emission surface is arranged at an opening of the body an in its operation position may be arranged at the level of the opening, slightly protruding from the opening or slightly being a short distance behind the plane of the opening. A control device is provided which effects, in one alternative version, that the ultrasonic waves are only emitted, if the ultrasonic wave emission surface is in contact or close to an object to be treated. The ultrasonic wave emission is interrupted when the ultrasonic wave emission surface is not in contact or not close to an object to be cleaned. By the control device the operation of the ultrasonic transducer is switched off or, in another alternative version, at least its intensity is strongly reduced when removing the ultrasonic wave emission surface from an object to be cleaned. Thereby no unintended emission of ultrasonic waves to the ear of the user or other parts of the body of the user may occur.

Preferably, the ultrasonic cleaning is performed by using a liquid applied to the textile product to be treated. The liquid may be applied to the textile product prior to using the ultrasonic cleaning apparatus or is preferably supplied from the ultrasonic apparatus from a liquid container within the ultrasonic cleaning apparatus or from a hose which connects the ultrasonic cleaning apparatus to a base unit providing the cleaning liquid. The cleaning liquid may be water or any cleaning detergent suitable for improving the cleaning result of the ultrasonic waves.

In a preferred embodiment the ultrasonic cleaning apparatus is a handheld device which can be freely moved. Correspondingly, the body of the ultrasonic cleaning apparatus is at least partially formed as a gripping element.

According to one embodiment of the invention a switch is arranged at or close to the opening of the body and as soon as the opening is brought into contact with the textile product the switch is operated and enables the ultrasonic transducer to emit ultrasonic waves. In this embodiment the ultrasonic wave emitting surface may be stationary arranged at or close to the opening of the body.

In an alternate embodiment a tip body part of the body is movably arranged at a main body part of the body and by moving the tip body part the ultrasonic wave emission surface approaches the opening of the body from the inside of the body. The control device detects the operation position of the tip body part and activates the ultrasonic transducer in this position. Advantageously the tip body part laterally surrounds the ultrasonic wave emission surface such that during operation no ultrasonic wave can be emitted backwards or to the side from the ultrasonic wave emission surface or the ultrasonic transducer.

Preferably the tip body part is biased by a biasing element which pushes the tip body part away from the main body part in a way that the ultrasonic wave emission surface is in a retreated position within the tip body part. The biasing force of the biasing element is at least strong enough to prevent the tip body part from moving to the main body part when the opening of the ultrasonic cleaning apparatus is pointing upwards.

In a further embodiment the ultrasonic transducer and ultrasonic wave emission surface are moveably arranged within the body wherein for operating the ultrasonic wave emission surface has to be moved from the inside of the body to the opening of the body. Preferably the control device detects the ultrasonic wave emission surface being located at the opening to start the operation of the ultrasonic transducer.

Reference is made in detail to preferred embodiments of the invention, examples of which are illustrated in the accompanying drawings. The drawings show:

FIG. 1 a handheld ultrasonic cleaner of a first embodiment and

Figure 2:
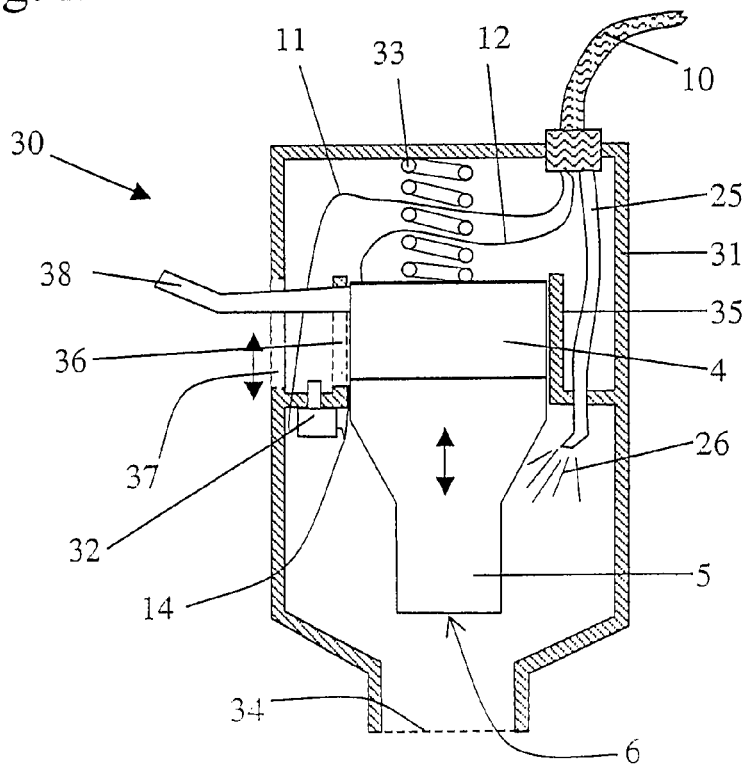

FIG. 2 an ultrasonic cleaner of a second embodiment.

FIG. 1 shows a cross section through a first embodiment of an ultrasonic cleaner 1. The ultrasonic cleaner 1 is held by a user on an outer surface of a main body 2. At the lower end of the main body 2 (as shown in FIG. 1) a shield member 3 is slidingly held within the main body 2. A piezo transducer 4 connected to a horn 5 is mounted within the main body 2. At the end face of the horn 5 ultrasonic waves are emitted from an emitting surface 6. The horn 5 is tapering to its end portion to amplify the ultrasonic vibration amplitude.

The shielding member 3 has an opening 7 and when the tip portion of the shield member 3 adjoining the opening 7 abuts a textile product to be cleaned, the shield member axially slides into the main body 2. When the user pushes the main body 2 down while the shield member 3 abuts on a textile product, the shield member 3 is pushed inwardly until the emitting surface 6 also abuts the textile product at the opening 7. In this position, a lever of a micro switch 16 is pushed down by a protrusion 21 at the inner end of the shield member 3.

The ultrasonic cleaner 1 is connected via a hose 10 to a washing machine, a dryer or a pre-treatment machine (not shown) which supplies the transducer driving signals to the piezo transducer 4 and a detergent liquid for cleaning the product. The electrical wave signal from the machine is transmitted via a first wire 11 to a push-button 15 to be operated by the user, if he wants to emit the ultrasonic waves. The push-button 15 is serial connected via a third wire 13 to the micro switch 16 and micro switch 16 through a fourth wire 14 to a first metalized surface of the piezo transducer 4. A second metalized surface of the piezo transducer 4 is connected to a second wire 12 which is guided back to the hose 10. First and second wires 11, 12 run through the hose to the machine where an electrical ultra wave signal generator is arranged.

If no compression force is applied between the shield member 3 and the main body 2, a spiral spring 20 between the main body 2 and the inner end of the shield member 3 pushes the shield member 3 to its outmost position where a further movement of the shield member 3 is stopped by a ledge 22 running at the inside of the cylindrical front end of the main body 2.

In the machine connected via hose 10 to the ultrasonic cleaner 1, a current detector is arranged for detecting a current from the ultrasonic generator to the piezoelectric ultrasonic transducer 4. As soon as a current is detected, i.e. as soon as push-button 15 and micro switch 16 close their electrical contacts, a liquid pump in the machine for supplying a cleaning detergent is activated and a detergent liquid is pumped through a conduit 25 arranged within the hose to a nozzle at the tip end of the conduit 25. A liquid jet 26 is sprayed from the nozzle to the opening 7 to humidify the textile product to be cleaned with the ultrasonic cleaner 1.

FIG. 2 shows a cross section of a second embodiment of an ultrasonic cleaner 30. Like elements have the like reference numerals and the function of driving the piezo transducer 4 and activating the liquid to be sprayed from the conduit 25 is as described above for the first embodiment shown in FIG. 1.

In ultrasonic cleaner 30 the transducer 4 and the horn 5 are slidingly contained in a sleeve 35 which is mounted in a main body 31. A lever 38 is connected to the piezo transducer 4 and passes through a first and a second slit 36, 37 in the sleeve 35 and the body 31, respectively. A user can depress the transducer 4 and the horn 5 with the emitting surface 6 by depressing the lever 38. With no force applied to the lever 38, the transducer 4 and horn 5 are pulled back into the body 31 by the pulling force of a spring 33 connected to the rear end of transducer 4. When the user depresses the lever 38, the horn and transducer slide downward into the direction of the opening 34, where the tip part of the body 31 abuts a textile product to be cleaned. When the emitting surface 6 is in its lower position (where it also abuts the textile product), the lever 38 contacts a lever of a micro switch 32 which closes a contact. In this position the ultrasonic signal transmitted by the first wire 11 is directly connected to the first conductive surface of piezo transducer 4 via wire 14. As mentioned above, the second metallic surface of transducer is connected to the generator in the machine (not shown) via the second wire 12.

In a modified embodiment (not shown) the ultra wave signal generator may be arranged within the main body 2 and in a further modified embodiment the power supply for the ultra wave generator is also arranged within the main body 2. This embodiment allows the ultrasonic cleaning apparatus to be used as stand-alone device without hose 10 when the cleaning liquid is applied separately to the stained textile product. In still a further modification, a detergent liquid container is provided in the main body of the ultrasonic cleaning apparatus such that the cleaning liquid is provided therefrom to the textile product.

REFERENCE NUMERAL LIST

1 ultrasonic cleaner
2 main body
3 shield member
4 piezoelectric transducer
5 horn
6 emitting surface
7 opening
10 hose
11 first wire
12 second wire
13 third wire
14 fourth wire
15 push-button
16 micro switch
20 spiral spring
21 protrusion
22 ledge
25 conduit
26 liquid jet
30 ultrasonic cleaner
31 body
32 switch
33 spring
34 opening
35 sleeve
36 first slit
37 second slit
38 lever

The invention claimed is:

1. Ultrasonic cleaning apparatus for treating a textile product comprising:

a body including an opening;

an ultrasonic transducer receiving ultrasonic wave signals generated by an ultrasonic signal generator;

an ultrasonic wave emission surface coupled to the ultrasonic transducer; and a control device adapted to detect the ultrasonic wave emission surface being in contact or in close proximity to an object and to stop the operation of the ultrasonic transducer or to reduce its emission intensity upon detection of the ultrasonic wave emission surface not being in contact or in close proximity to the object, wherein the body of the ultrasonic cleaning apparatus is a handheld device that can be freely moved and is at least partially formed as a gripping element for a user of the ultrasonic cleaning apparatus, and wherein the ultrasonic transducer and the ultrasonic wave emission surface are movably arranged within the body by a user-operable actuator element, and wherein in an operation position the ultrasonic wave emission surface is aligned with the opening or protruding from the opening, and wherein in a rest position the ultrasonic wave emission surface is retracted from the opening.

2. Apparatus according to claim 1, wherein the control device is a switch operated by a contact element arranged at the opening of the body, a position detector adapted to detect the variable position of the ultrasonic wave emitting surface being close to or at the opening, or a proximity switch adapted to detect a distance between the ultrasonic wave emitting surface and an object.

3. Apparatus according to claim 1, wherein the control device detects the ultrasonic wave emission surface being in the operation position.

4. Apparatus according to claim 1, wherein the actuator element includes a handle element adapted to be operated by a user of the ultrasonic cleaning apparatus, wherein the actuator element is coupled to the ultrasonic transducer and ultrasonic wave emission surface to move them from the rest position to the operation position upon operating the handle element.

5. Household appliance comprising an apparatus according to claim 1.

6. Household appliance according to claim 5, wherein the household appliance is a washing machine, a dryer or a refreshment machine.

7. Household appliance according to claim 5, wherein the household appliance and the ultrasonic cleaning apparatus are connected via a flexible hose, and wherein electrical leads and/or a cleaning liquid conduit are provided in the hose.

8. Household appliance according to claims 5, wherein the ultrasonic signal generator is arranged in the household appliance.

* * * * *